US011124014B2

(12) United States Patent
Celio et al.

(10) Patent No.: US 11,124,014 B2
(45) Date of Patent: Sep. 21, 2021

(54) GRIDDED CARRIER SHEET PROVIDING ALIGNMENT AND CUTTING GUIDES FOR A DECORATIVE TRANSFER

(71) Applicant: IRON ORCHID DESIGNS, LLC, Lincoln, CA (US)

(72) Inventors: Josie G. Celio, Garden Valley, CA (US); Sally O. Griswold, Lincoln, CA (US)

(73) Assignee: IRON ORCHID DESIGNS, LLC, Lincoln, CA (US)

( * ) Notice: Subject to any disclaimer, the term of this patent is extended or adjusted under 35 U.S.C. 154(b) by 0 days.

(21) Appl. No.: 17/232,684

(22) Filed: Apr. 16, 2021

(65) Prior Publication Data

US 2021/0229487 A1 Jul. 29, 2021

Related U.S. Application Data

(63) Continuation of application No. 17/109,850, filed on Dec. 2, 2020.

(60) Provisional application No. 62/943,040, filed on Dec. 3, 2019.

(51) Int. Cl.
*B44C 1/16* (2006.01)
*B44C 1/17* (2006.01)

(52) U.S. Cl.
CPC ..... *B44C 1/162* (2013.01); *B44C 1/1737* (2013.01)

(58) Field of Classification Search
CPC ..... B44C 1/162; B44C 1/1737
See application file for complete search history.

(56) References Cited

U.S. PATENT DOCUMENTS

| | | | | |
|---|---|---|---|---|
| 3,761,344 | A * | 9/1973 | Mrozek et al. | G09F 3/10 428/42.2 |
| 3,945,141 | A | 3/1976 | Frost | |
| 4,339,886 | A * | 7/1982 | Griffiths | G09F 7/16 40/595 |
| 4,900,392 | A * | 2/1990 | Bradshaw | B44C 1/162 156/235 |
| 4,986,573 | A * | 1/1991 | Brunhoefer | B44C 1/162 283/115 |
| 5,673,490 | A | 10/1997 | Hill | |
| 6,688,364 | B2 * | 2/2004 | Simpson | B44C 1/10 156/230 |

FOREIGN PATENT DOCUMENTS

| | | | | |
|---|---|---|---|---|
| CA | 2158258 | A1 * | 10/1994 | B44C 1/162 |
| DE | 2331807 | C3 | 5/1982 | |
| FR | 2579524 | B1 | 5/1987 | |
| FR | 2596676 | B1 | 7/1991 | |

OTHER PUBLICATIONS

English translation of FR2596676.*
English translation of DE2331807.*
English translation of CA2158252A1.*
English translation of DE3429501.*
English translation of DE6750410.*

* cited by examiner

*Primary Examiner* — Sonya M Sengupta
(74) *Attorney, Agent, or Firm* — O'Banion & Ritchey LLP; John P. O'Banion

(57) ABSTRACT

A transparent or translucent carrier sheet is provided with an alignment grid for positioning a decorative transfer.

9 Claims, 5 Drawing Sheets

32

GRIDDED CARRIER SHEET PROVIDING ALIGNMENT AND CUTTING GUIDES FOR A DECORATIVE TRANSFER

CROSS-REFERENCE TO RELATED APPLICATIONS

This application is a continuation of U.S. patent application Ser. No. 17/109,850 filed on Dec. 2, 2020, incorporated herein by reference in its entirety, which application claims priority to, and the benefit of, U.S. provisional patent application Ser. No. 62/943,040 filed on Dec. 3, 2019, incorporated herein by reference in its entirety.

STATEMENT REGARDING FEDERALLY SPONSORED RESEARCH OR DEVELOPMENT

Not Applicable

NOTICE OF MATERIAL SUBJECT TO COPYRIGHT PROTECTION

A portion of the material in this patent document may be subject to copyright protection under the copyright laws of the United States and of other countries. The owner of the copyright rights has no objection to the facsimile reproduction by anyone of the patent document or the patent disclosure, as it appears in the United States Patent and Trademark Office publicly available file or records, but otherwise reserves all copyright rights whatsoever. The copyright owner does not hereby waive any of its rights to have this patent document maintained in secrecy, including without limitation its rights pursuant to 37 C.F.R. § 1.14.

BACKGROUND

1. Technical Field

The technology of this disclosure pertains generally to transferring artwork to an object, and more particularly to applying rub on type transfers to the surface of an object.

2. Background Discussion

Decorative transfers are popular for enhancing the appearance of an object, such as surfaces of furniture, walls, cabinets, windows and other object. Typically decorative transfers are printed onto a plain, clear, carrier sheet. When applying the transfer to a surfaces it can be difficult to position the transfer, keep design level with the furniture lines, and difficult to cut a straight line for aligning the cut portion properly.

BRIEF SUMMARY

This disclosure describes a decorative transfer apparatus having a gridded carrier sheet. This disclosure also describes a gridded carrier sheet for decorative transfers. The gridded carrier sheet provides a backing for the decorative transfer that makes it easy to position the transfer prior to application to a surface as well as makes it easy to cut the transfer along straight lines when needed.

In one embodiment, a carrier sheet is provided with an alignment grid printed onto one side of the carrier sheet and a decorative transfer printed onto the other side. By way of example, and not of limitation, the decorative transfer can be one or more decorative designs, images, or text, or combinations thereof. The particular content of the decorative transfer is not an essential element of the combination of the gridded carrier sheet and decorative transfer described herein. The carrier sheet is preferably transparent but can be translucent to the extent that the decorative transfer is not obscured when viewed through the carrier sheet.

The gridded carrier sheet is particularly suitable for use with rub on type decorative transfers but not limited thereto. When used with rub on type transfers, the user applies pressure to the surface of the carrier sheet opposite the transfer (e.g., the transfer is against the surface to which it is to be applied) by rubbing over the area of the transfer. The carrier sheet is then pulled or peeled away after the decorative transfer is affixed to the surface.

Prior to applying the decorative transfer, the user views the transfer through the gridded side of the carrier sheet. When viewed from this position, the grid overlays the decorative transfer. The user can elect to use the decorative transfer in its original form or, for example, by using the grid pattern as a guide, cut around the transfer or cut the transfer itself. The user can also use the grid pattern as a guide for positioning the transfer onto the surface.

For example, a person views the decorative transfer and the object to which the decorative transfer will be applied. The user then uses the grid lines to trim the transfer with straight lines in order to line it up properly with straight edges. The user can also use the grid lines to level the transfer by aligning the grid lines perpendicular or parallel to the lines of the object.

It will also be appreciated that it might be desirable to apply a decorative transfer to a surface but it would not be practical to use one transfer sheet due to size. In that case, the image can be broken down into sections and the sections carried on separate carrier sheets. In one embodiment, the grid pattern provides registration marks in the area of at least one edge of the carrier sheet such that multiple carrier sheets can be aligned in relation to each other.

Further aspects of the technology described herein will be brought out in the following portions of the specification, wherein the detailed description is for the purpose of fully disclosing preferred embodiments of the technology without placing limitations thereon.

BRIEF DESCRIPTION OF THE SEVERAL VIEWS OF THE DRAWING(S)

The technology described herein will be more fully understood by reference to the following drawings which are for illustrative purposes only:

DETAILED DESCRIPTION

Figure 1:
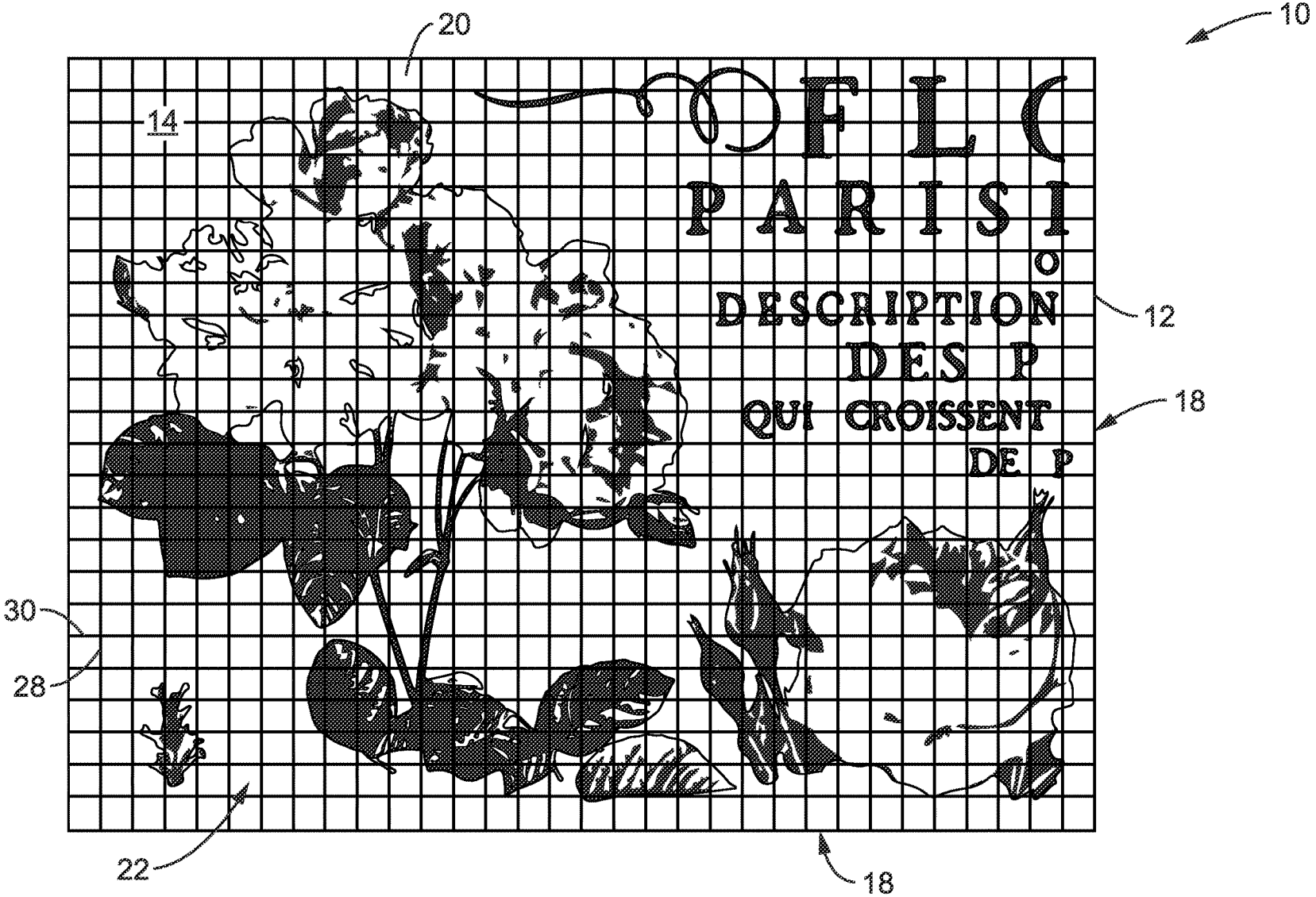
FIG. 1 shows a side of an embodiment of a decorative transfer apparatus according to the present disclosure.
Figure 2:
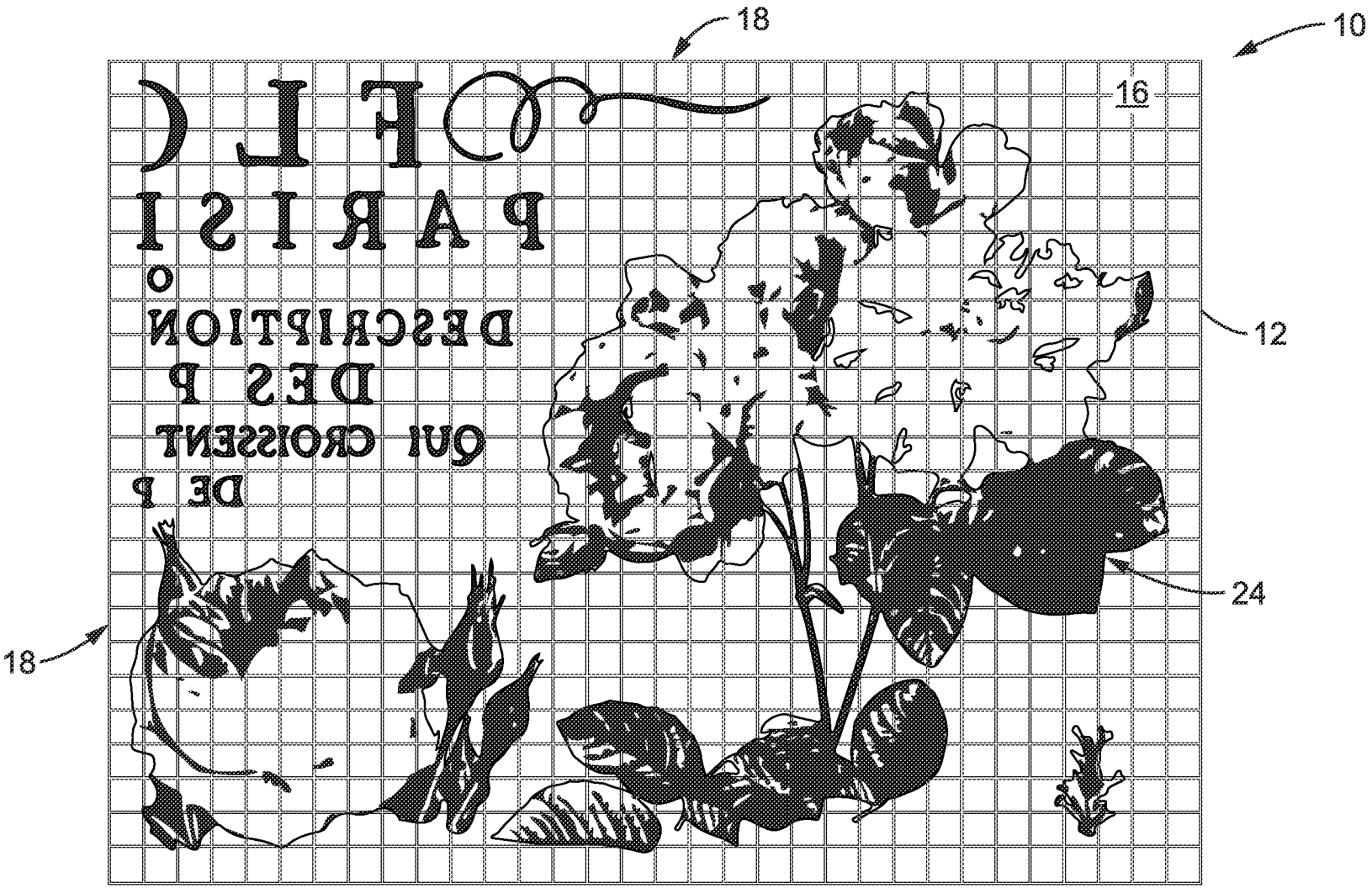
FIG. 2 shows the reverse side of the apparatus of FIG. 1.

Referring first to FIG. 1 and FIG. 2, in one embodiment a decorative transfer apparatus 10 comprises a carrier sheet 12 with a first side 14 and a second side 16, and a plurality of edges 18. While a rectangular shaped carrier sheet is shown, the shape can be square, circular, triangular, or other shapes without departing from the technology described herein. The first side 14 of the carrier sheet 12 has a plurality of squares, rectangles or the like 20 that are arranged to form a grid pattern 22.

The grid pattern 22 is preferably printed on the first side 14 of the carrier sheet 12 but can be applied using other conventional techniques known to those skilled in the art. The grid pattern could also be cut or etched into the first side 14 of the carrier sheet 12 and the resultant grooves filled with ink, paint or other visible material. The grid pattern could also be embedded in the carrier sheet 12. Accordingly, as used in this disclosure, when a grid pattern is said to be "on" a side of the carrier sheet the term "on" is intended to encompass any of the foregoing grid pattern implementations.

A decorative transfer 24 is carried on the second side 16 of the carrier sheet 12. In a preferred embodiment, the decorative transfer 24 is printed on the second side 16 of the carrier sheet 12 but other conventional techniques known to those skilled in the art can be used as well. Accordingly, as used in this disclosure, when a decorative transfer is said to be "on" a side of the carrier sheet the term "on" is intended to encompass any conventional attachment or placement technique on the carrier sheet.

It will be appreciated that, while the grid pattern 22 and the decorative transfer 24 preferably are on opposite sides of the carrier sheet 12, both the grid pattern 22 and the decorative transfer 24 could be on the same side of the carrier sheet 12.

It is important that the decorative transfer 24 can be viewed through the carrier sheet 12 when being applied to the surface of an object as depicted in FIG. 1. Accordingly, the carrier sheet 12 is preferably transparent, but the carrier sheet can be translucent provided that the decorative transfer 24 is not obscured and can be seen clearly when viewed through the carrier sheet. FIG. 1 illustrates how the decorative transfer would be viewed through the first side 14 of the carrier sheet 12.

It will also be appreciated that the particular content of the decorative transfer 24 is essentially unlimited. By way of example, and not of limitation, the decorative transfer 24 can be one or more decorative designs, images, numbers, or text, or combinations thereof.

Preferably the decorative transfer comprises a material that can be transferred to an object by applying a rubbing pressure to the carrier sheet while the decorative transfer is held against the surface of the object. Those having ordinary skill in the art will readily appreciate materials that can be used for decorative transfers.

Figure 3:
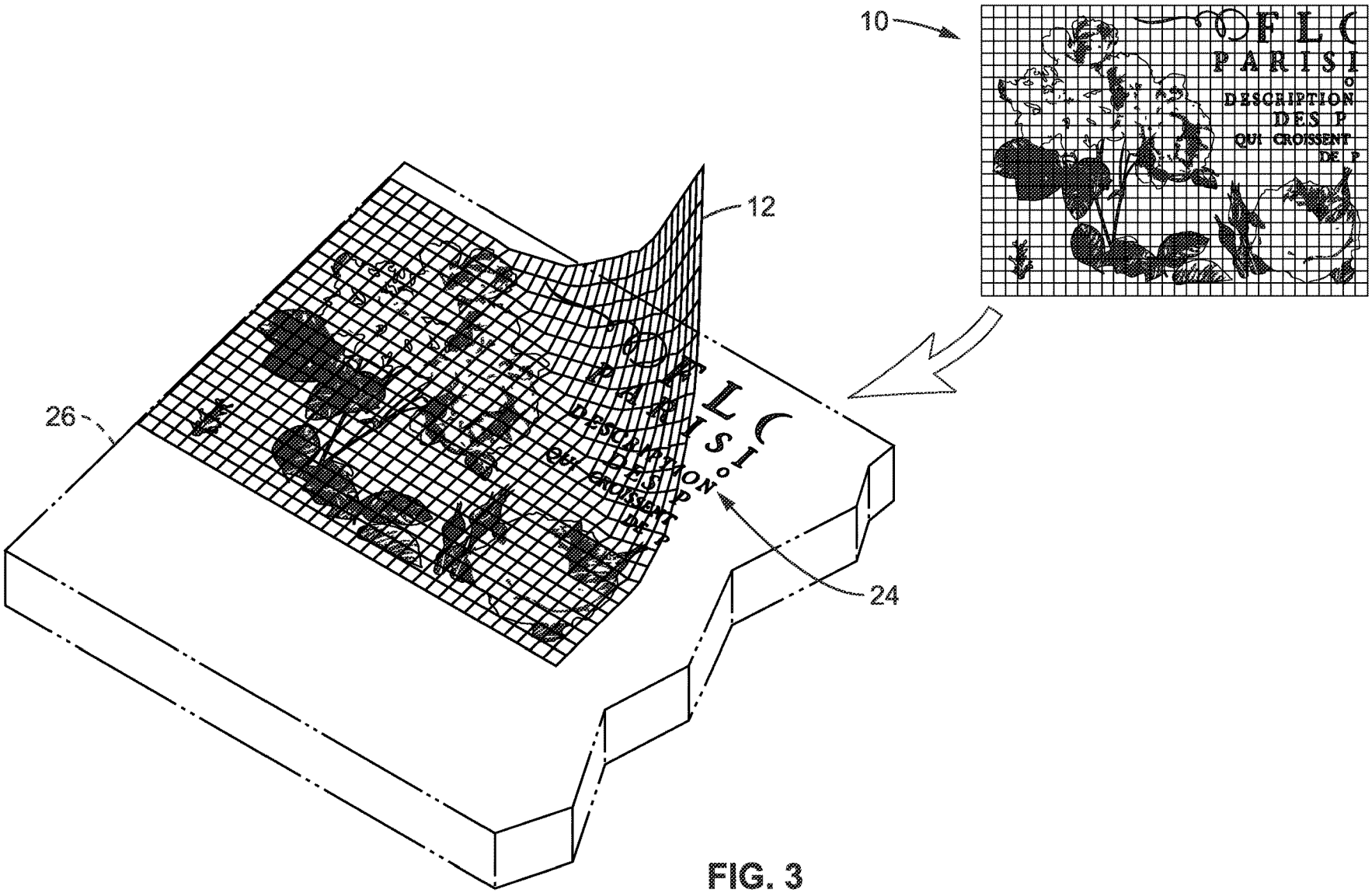
FIG. 3 illustrates applying a decorative transfer to an object according to an embodiment of the present disclosure.

As illustrated in FIG. 3, after the decorative transfer 24 is applied to an object 26 the carrier sheet 12 is peeled, pulled away, or otherwise removed and discarded.

It will be appreciated that the gridded carrier sheet makes it easy to manipulate and apply the decorative transfer to the surface of an object. In one embodiment, prior to applying the decorative transfer 24 the user views the decorative transfer 24 through the gridded first side 14 of the carrier sheet 12. When viewed from this position, the grid pattern 22 overlays the decorative transfer 24. The user can elect to apply the decorative transfer 24 in its original form or, for example, using the grid pattern 22 as a guide, by first cutting an area adjacent the decorative transfer 24 or cutting the decorative transfer 24 itself. The user can also use the grid pattern 22 as a guide for positioning the transfer onto the surface. This can be done, for example, by using the grid pattern 22 to visually position the transfer. The user can also use the lines 28, 30 in the grid pattern 22 to trim the decorative transfer with straight lines in order to line it up properly with straight edges. The user can further use the lines 28, 30 in the grid pattern 22 to level the decorative transfer 24 by aligning the lines perpendicular or parallel to the lines of the object to which the decorative transfer is being applied.

Figure 4:
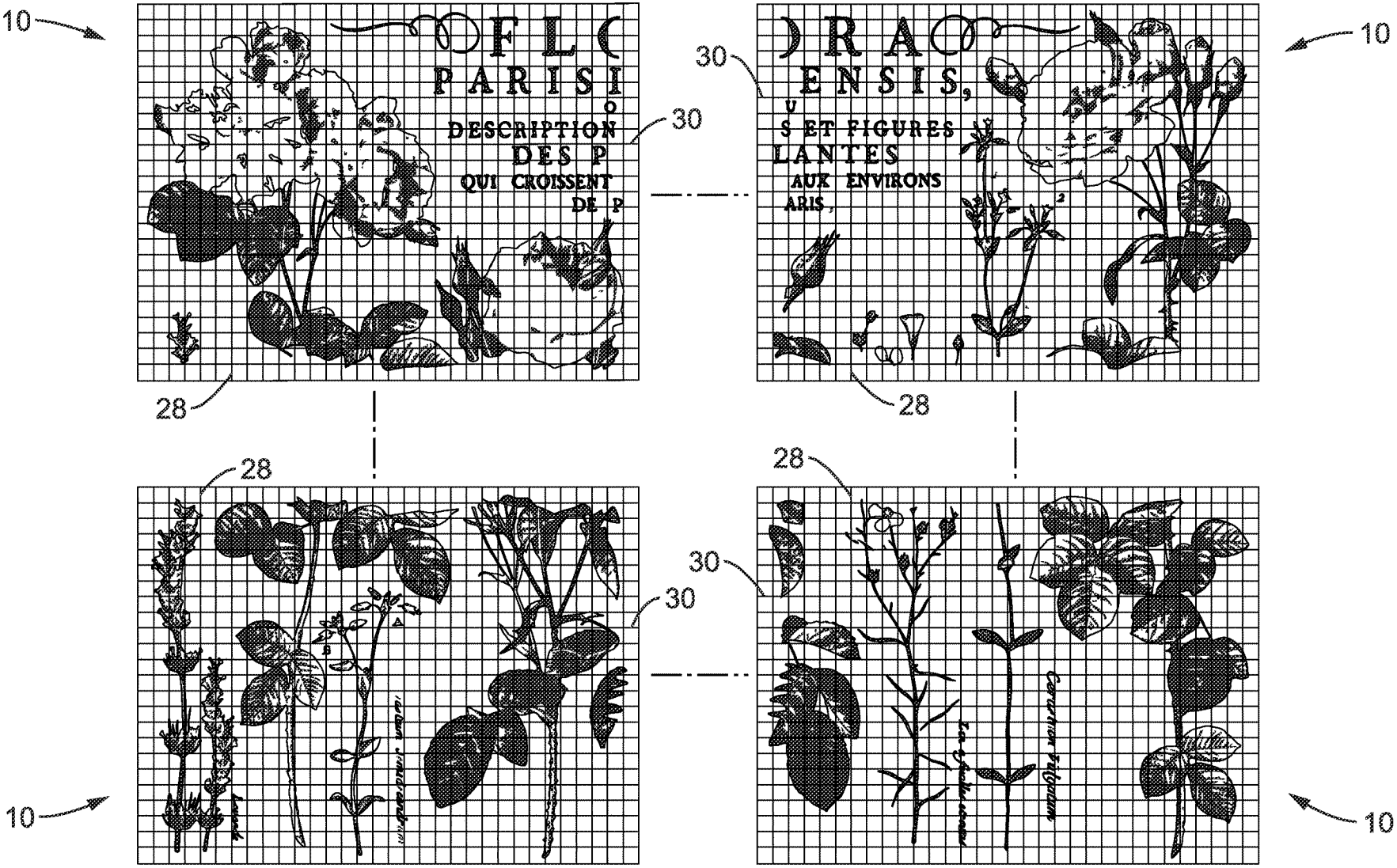
FIG. 4 illustrates multiple decorative transfer apparatus sections for forming a larger composite image according to an embodiment of the present disclosure.
Figure 5:
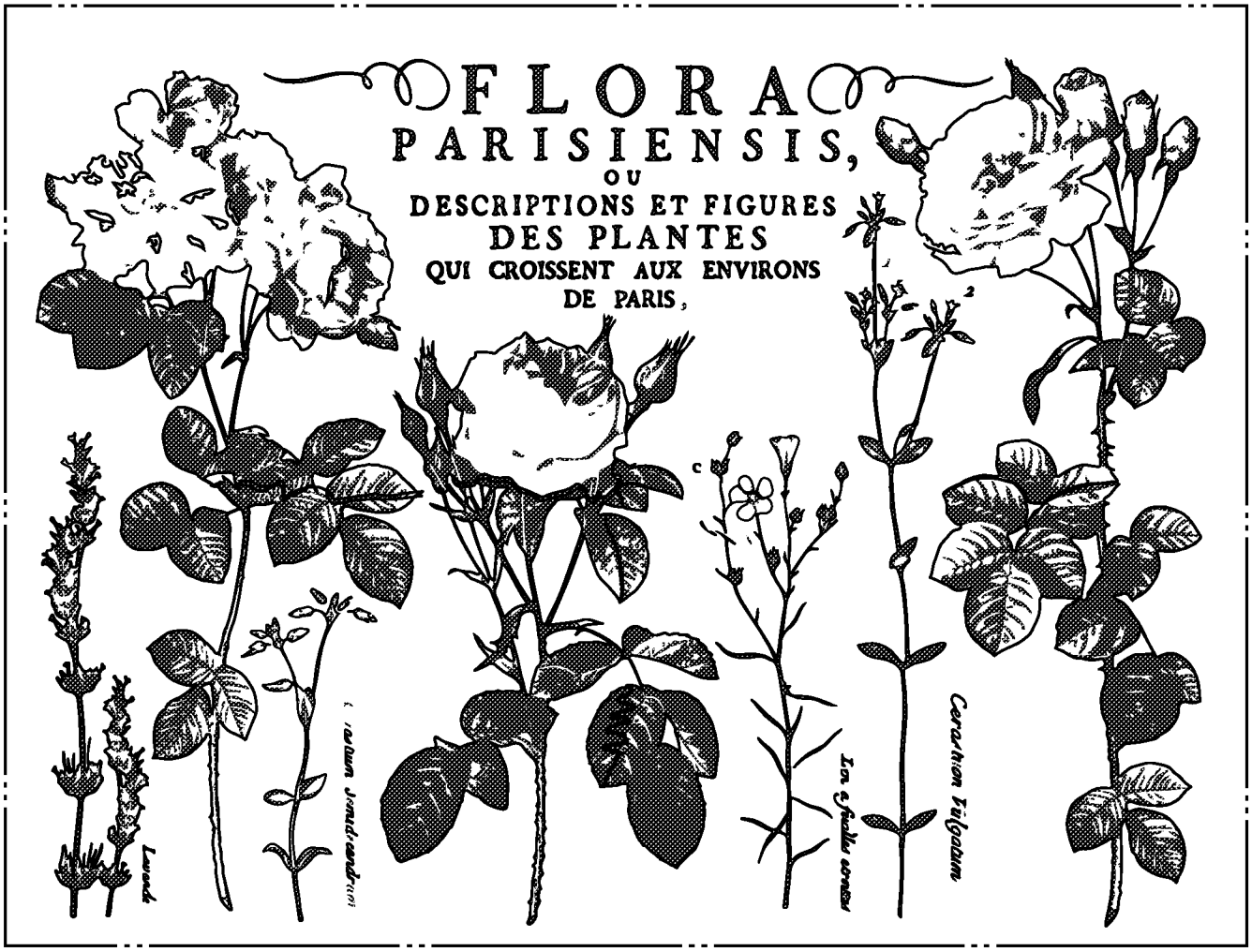
FIG. 5 illustrates a composite image formed using multiple decorative transfer apparatus sections according to an embodiment of the present disclosure.

Referring to FIG. 4 and FIG. 5, it will also be appreciated that it might be desirable to apply a decorative transfer to a surface but it would not be practical to use one transfer sheet due to size. In that case, a decorative transfer can be broken down into sections and the sections carried on separate carrier sheets. In one embodiment, the lines 28, 30 in the area of one or more of edges of the carrier sheet 12 can be used as registration marks so that the carrier sheets can be positioned to form a larger composite image 32. Separate registration markings can also be provided if desired.

From the description herein, it will be appreciated that the present disclosure encompasses multiple embodiments which include, but are not limited to, the following:

1. A decorative transfer apparatus, comprising: (a) a carrier sheet; (b) the carrier sheet having a grid pattern; and (c) a decorative transfer on the carrier sheet; (d) wherein the decorative transfer can be seen through the carrier sheet with the grid pattern overlaying the decorative transfer when the decorative transfer is positioned to be applied to an object.

2. A decorative transfer apparatus, comprising: (a) a carrier sheet having a first side and a second side; (b) a grid pattern on the first side of the carrier sheet; and (c) a decorative transfer on the second side of the carrier sheet; (d) wherein the decorative transfer can be seen through the carrier sheet with the grid pattern overlaying the decorative transfer when the carrier sheet is viewed from the first side.

3. In a carrier sheet for a decorative transfer, an improvement comprising: (a) the carrier sheet having a grid pattern; (b) wherein a decorative transfer on the carrier sheet can be seen through the carrier sheet with the grid pattern overlaying the decorative transfer when the decorative transfer is positioned to be applied to an object.

4. In a carrier sheet for a decorative transfer, the carrier sheet having a first side and a second side, an improvement comprising: (a) a grid pattern on the first side of the carrier sheet; (b) wherein a decorative transfer on the second side of the carrier sheet can be seen through the carrier sheet with the grid pattern overlaying the decorative transfer when the carrier sheet is viewed from the first side.

5. A method for applying a decorative transfer, comprising: (a) providing a carrier sheet; (b) the carrier sheet having a grid pattern; (c) the carrier sheet having a decorative transfer; (d) wherein the decorative transfer can be seen through the carrier sheet with the grid pattern overlaying the decorative transfer when the decorative transfer is positioned to be applied to an object; (e) placing the decorative transfer adjacent a surface of an object; and (f) rubbing the carrier sheet to affix the decorative transfer on the surface of the object.

6. A method for applying a decorative transfer, comprising: (a) providing a carrier sheet having a first side and a second side; (b) the carrier sheet having a grid pattern on the first side; (c) the carrier sheet having a decorative transfer on the second side of the carrier sheet; (d) wherein the decorative transfer can be seen through the carrier sheet with the grid pattern overlaying the decorative transfer when the carrier sheet is viewed from the first side; (e) placing the decorative transfer adjacent a surface of an object; and (f) rubbing the first side of the carrier sheet to affix the decorative transfer on the surface of the object.

7. The method of any preceding embodiment, further comprising using the grid pattern for alignment of the decorative transfer on the surface of the object.

8. The method of any preceding embodiment, further comprising using the grid pattern as a guide for cutting an area adjacent the decorative transfer.

9. The method of any preceding embodiment, further comprising using the grid pattern as a guide for cutting the decorative transfer.

10. The apparatus, improvement or method of any preceding embodiment, wherein the carrier sheet is transparent or translucent.

11. The apparatus, improvement or method of any preceding embodiment, wherein the grid pattern provides registration marks in the area of at least one edge of the carrier sheet such that multiple carrier sheets can be aligned in relation to each other.

As used herein, the singular terms "a," "an," and "the" may include plural referents unless the context clearly dictates otherwise. Reference to an object in the singular is not intended to mean "one and only one" unless explicitly so stated, but rather "one or more."

Phrasing constructs, such as "A, B and/or C", within the present disclosure describe where either A, B, or C can be present, or any combination of items A, B and C. Phrasing constructs indicating, such as "at least one of" followed by listing group of elements, indicates that at least one of these group elements is present, which includes any possible combination of these listed elements as applicable.

References in this specification referring to "an embodiment", "at least one embodiment" or similar embodiment wording indicates that a particular feature, structure, or characteristic described in connection with a described embodiment is included in at least one embodiment of the present disclosure. Thus, these various embodiment phrases are not necessarily all referring to the same embodiment, or to a specific embodiment which differs from all the other embodiments being described. The embodiment phrasing should be construed to mean that the particular features, structures, or characteristics of a given embodiment may be combined in any suitable manner in one or more embodiments of the disclosed apparatus, system or method.

As used herein, the term "set" refers to a collection of one or more objects. Thus, for example, a set of objects can include a single object or multiple objects.

As used herein, the terms "approximately", "approximate", "substantially" and "about" are used to describe and account for small variations. When used in conjunction with an event or circumstance, the terms can refer to instances in which the event or circumstance occurs precisely as well as instances in which the event or circumstance occurs to a close approximation. When used in conjunction with a numerical value, the terms can refer to a range of variation of less than or equal to ±10% of that numerical value, such as less than or equal to ±5%, less than or equal to ±4%, less than or equal to ±3%, less than or equal to ±2%, less than or equal to ±1%, less than or equal to ±0.5%, less than or equal to ±0.1%, or less than or equal to ±0.05%. For example, "substantially" aligned can refer to a range of angular variation of less than or equal to ±10°, such as less than or equal to ±5°, less than or equal to ±4°, less than or equal to ±3°, less than or equal to ±2°, less than or equal to ±1°, less than or equal to ±0.5°, less than or equal to ±0.1°, or less than or equal to ±0.05°.

Additionally, amounts, ratios, and other numerical values may sometimes be presented herein in a range format. It is to be understood that such range format is used for convenience and brevity and should be understood flexibly to include numerical values explicitly specified as limits of a range, but also to include all individual numerical values or sub-ranges encompassed within that range as if each numerical value and sub-range is explicitly specified. For example, a ratio in the range of about 1 to about 200 should be understood to include the explicitly recited limits of about 1 and about 200, but also to include individual ratios such as about 2, about 3, and about 4, and sub-ranges such as about 10 to about 50, about 20 to about 100, and so forth.

Although the description herein contains many details, these should not be construed as limiting the scope of the disclosure but as merely providing illustrations of some of the presently preferred embodiments. Therefore, it will be appreciated that the scope of the disclosure fully encompasses other embodiments which may become obvious to those skilled in the art.

All structural and functional equivalents to the elements of the disclosed embodiments that are known to those of ordinary skill in the art are expressly incorporated herein by reference and are intended to be encompassed by the present claims. Furthermore, no element, component, or method step in the present disclosure is intended to be dedicated to the public regardless of whether the element, component, or method step is explicitly recited in the claims. No claim element herein is to be construed as a "means plus function" element unless the element is expressly recited using the phrase "means for". No claim element herein is to be construed as a "step plus function" element unless the element is expressly recited using the phrase "step for".

What is claimed is:

1. A decorative transfer apparatus, comprising:

(a) a carrier sheet;

(b) the carrier sheet having a grid pattern; and (c) a decorative transfer on the carrier sheet;

(d) wherein the decorative transfer can be seen through the carrier sheet with the grid pattern overlaying the decorative transfer when the decorative transfer is positioned to be applied to an object;

(e) wherein the carrier sheet has a first side and a second side;

(f) wherein the grid pattern is on the first side of the carrier sheet;

(g) wherein the decorative transfer is on the second side of the carrier sheet; and (h) wherein the decorative transfer can be seen through the carrier sheet with the grid pattern overlaying the decorative transfer when the carrier sheet is viewed from the first side.

2. The apparatus of claim 1, wherein the carrier sheet is transparent or translucent.

3. In a carrier sheet for a decorative transfer, an improvement comprising:

(a) the carrier sheet having a grid pattern;

(b) wherein a decorative transfer on the carrier sheet can be seen through the carrier sheet with the grid pattern overlaying the decorative transfer when the decorative transfer is positioned to be applied to an object;

(c) wherein the carrier sheet has a first side and a second side;

(d) wherein the grid pattern is on the first side of the carrier sheet; and (e) wherein a decorative transfer on the second side of the carrier sheet can be seen through the carrier sheet with the grid pattern overlaying the decorative transfer when the carrier sheet is viewed from the first side.

4. The improvement of claim 3, wherein the carrier sheet is transparent or translucent.

5. A method for applying a decorative transfer, comprising:

(a) providing a carrier sheet;

(b) the carrier sheet having a grid pattern;

(c) the carrier sheet having a decorative transfer;

(d) wherein the decorative transfer can be seen through the carrier sheet with the grid pattern overlaying the decorative transfer when the decorative transfer is positioned to be applied to an object;

(e) placing the decorative transfer adjacent a surface of an object; and (f) rubbing the carrier sheet to affix the decorative transfer on the surface of the object;

(g) wherein the carrier sheet has a first side and a second side;

(h) wherein the grid pattern is on the first side of the carrier sheet;

(i) wherein the decorative transfer is on the second side of the carrier sheet; and (j) wherein the decorative transfer can be seen through the carrier sheet with the grid pattern overlaying the decorative transfer when the carrier sheet is viewed from the first side.

6. The method of claim 5, further comprising using the grid pattern for alignment of the decorative transfer on the surface of the object.

7. The method of claim 5, further comprising using the grid pattern as a guide for cutting an area adjacent the decorative transfer.

8. The method of claim 5, further comprising using the grid pattern as a guide for cutting the decorative transfer.

9. The method of claim 5, wherein the carrier sheet is transparent or translucent.

* * * * *